United States Patent [19]

DeBlois

[11] Patent Number: 4,913,262

[45] Date of Patent: Apr. 3, 1990

[54] MECHANICAL CONNECTION ELEMENT

[75] Inventor: Martin DeBlois, L'Islet sur Mer, Canada

[73] Assignee: Les Industries Amisco Ltee, L'Islet, Canada

[21] Appl. No.: 270,801

[22] Filed: Nov. 14, 1988

[51] Int. Cl.[4] ..... E06C 1/36

[52] U.S. Cl. ..... 182/97; 182/206; 5/9 B; 403/353

[58] Field of Search ..... 182/206, 97, 92; 5/9 B; 403/353, 407.1

[56] References Cited

U.S. PATENT DOCUMENTS

| | | | |
|---|---|---|---|
| 691,885 | 1/1902 | Abney | 403/353 |
| 2,404,523 | 7/1946 | Nesson | 403/353 |
| 2,767,032 | 10/1956 | Mitchell | 182/206 |
| 3,360,075 | 12/1967 | Gutner | 182/206 |
| 3,557,906 | 1/1971 | Gutner | 182/206 |
| 4,193,146 | 3/1980 | Fredman | 5/9 B |
| 4,257,492 | 3/1981 | Rasada | 182/206 |

FOREIGN PATENT DOCUMENTS 1183745 12/1964 Fed. Rep. of Germany ..... 403/353

*Primary Examiner*—Reinaldo P. Machado

*Attorney, Agent, or Firm*—Foley & Lardner, Schwartz, Jeffery, Schwaab, Mack, Blumenthal & Evans

[57] ABSTRACT

A mechanical connection element comprising a substantially rigid body having therein a cylindrical through cavity accessible via a channel to the outside of the body. This element (or anything attached thereto) can be secured simply, reversibly and perpendicularly to a cross-sectionally rectangular bar. Thus, in one orientation, the bar passes through the channel and into the cavity but in a second orientation, achieved by rotation of the bar, is retained in the cavity. Two such connection elements may advantageously be used atop a bunk-bed ladder for safe affixment to a horizontal bar of the bunk. The element ensures such a ladder be unremoveable when in operative mode.

15 Claims, 2 Drawing Sheets

MECHANICAL CONNECTION ELEMENT

BACKGROUND OF THE INVENTION (i) Field of the Invention

The present invention relates to a mechanical connection element for removeable and essentially perpendicular connection to a cross-sectionally rectangular bar.

(ii) Description of the Prior Art

The origin of the present invention was the unsatisfactory way in which bunk bed ladders were attached to the raised bunks they were intended to service.

Two main forms of attachment exist in the prior art. The first uses (usually metal) hooks on the two upper extremities of the ladder side rails. These hooks have an inverted U-shape so that they may be placed in variable lateral positions over the side of the raised bunk bed and later removed if necessary. Not only do the metal hooks often scrape the beds but they are potentially injurious to the children who often play in and around such bunks. However the chief disadvantage of these hooks is their insecure attachment such that one or both hooks may easily be dislodged for instance by playing children even when the ladder rests on the floor. This poses a danger to the bunk user.

The second kind of bunk ladder currently in use is of the permanent attachment kind wherein the upper extremities of the ladder are rigidly attached, usually by bolts, to the bed frame. Although this arrangement circumvents the instability of the above discussed hook design, the removeability and variable positioning allowed by the hooks is lost.

It is therefore clearly desirable to provide a bunk ladder which combines the advantages but avoids the disadvantages of the above two designs.

In seeking to satisfy this desire, the present inventor broadened his objectives to seek a general mechanical connection element of the kind mentioned at the outset.

OBJECTS OF THE INVENTION

It is an object of the present invention to provide a mechanical connection element for removeable and essentially perpendicular connection to a cross-sectionally rectangular bar.

It is another object of this invention to provide such an element which in one orientation may be affixed to the bar by simple positioning but that may be rotated, after affixment, to a second orientation in which the bar and the element are inseparable.

It is also an object that the first orientation (for affixment) be narrowly defined such that affixment requires careful mutual positioning of the bar and the element while the second orientation (for inseparability) be broadly defined so that any of a range of orientations of the element with respect to the bar will achieve the desired inseparability.

It is a further object to provide a modular such element which may thus be secured to any of a variety of secondary construction elements to render these latter attachable to the bar.

It is another object to fabricate the element from a nonscratch material.

Returning to the problem of bunk bed ladders, it is a further object to provide a ladder which, in one orientation, is rigidly attached to a raised bunk, while in another orientation is easily and reversibly detachable from the bunk.

Another object is to have a ladder affixable only when in an approximately horizontal position thus precluding ladder removal by small children.

Another object is to have a ladder which may not be removed when in operation i.e. when the ladder legs are on or near the floor.

SUMMARY OF THE INVENTION

In its broadest form and in meeting the above as well as other objects, the invention provides a mechanical connection element for removeable and essentially perpendicular connection to a generally cross-sectionally rectangular bar having two long sides and two short sides. The element comprises a substantially rigid body having a cylindrical through cavity able to accommodate the bar by frictional contact thereof with the interior surface of the cavity. The cavity communicates with the exterior surface of the body by a radial, laterally open channel having sides spaced apart at least slightly more than the width of the short side of the bar but less than the long side. This allows entrance of the bar into the cavity such that after such entrance, the bar is rotatable to an orientation from which perpendicular exit of the bar (along the same path) from the cavity is prevented.

More particularly, the invention provides a ladder for a raised bunk bed, the ladder comprising rungs and two side rails, each surmounted by a mechanical connection element for removeable and essentially perpendicular connection to a horizontal, generally cross-sectionally rectangular bar having two long sides and two short sides, the bar forming a part of the bed. Each of the elements comprises a substantially rigid body having a cylindrical through cavity able to accommodate the bar by frictional contact between it and the inner surface of the cavity. The cavity communicates with the exterior surface of the body by a radial, laterally open channel occupying less than a 45° arc of the cavity. The cavity is also approximately perpendicular to the side rails and has sides spaced apart at least slightly more than the width of the short side but less than the long side. This allows entrance of the bar into the cavity, when the ladder is approximately horizontal. After entry, the ladder is downwardly rotatable about the bar until the side rails of the ladder are at least 45° to the horizontal. This prevents exit of the bar from the cavity.

The term "generally rectangular" in this context is intended to mean any shape which may be fitted into the outline of a rectangle or which is substantially rectangular save for some minor adornment or adjunctive structural features.

The term "substantially rigid" includes any rigid substance like metal or wood but may also include polymers or fibre composites possessing minor degrees of flexibility.

BRIEF DESCRIPTION OF THE DRAWINGS

In non-restrictive illustration of preferred embodiments of the invention.

DESCRIPTION OF THE PREFERRED EMBODIMENTS

Figure 1:
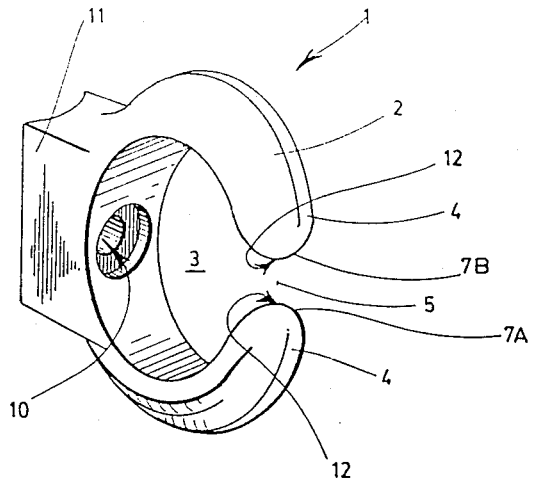
FIG. 1 shows a perspective view of one embodiment.

In what follows, the same reference numerals apply to all figures.

Figure 2:
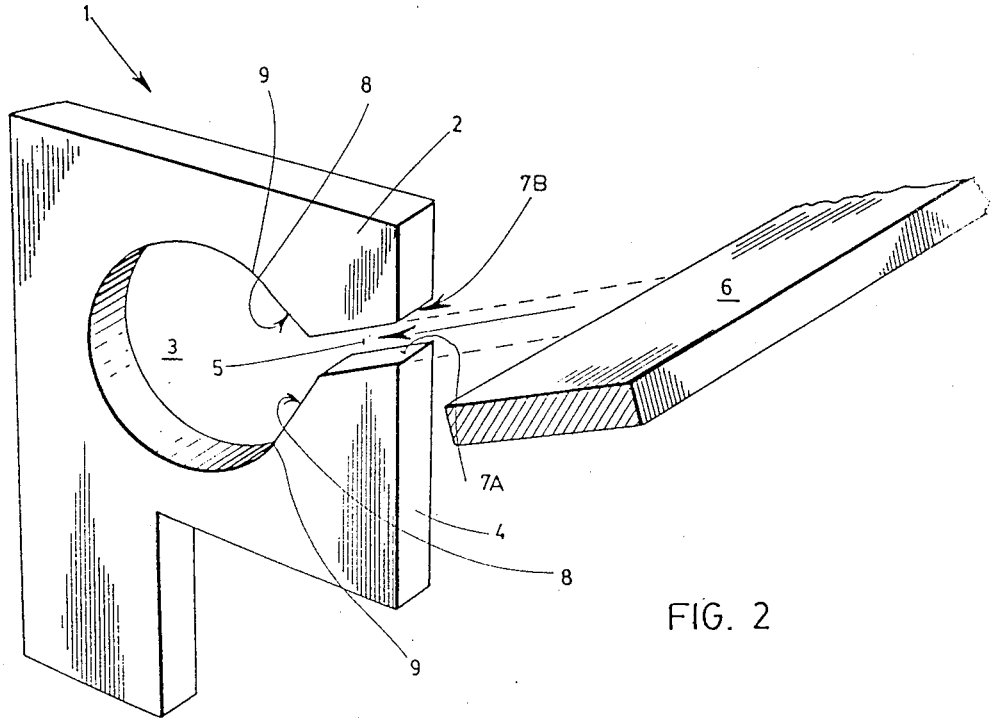
FIG. 2 shows a perspective view of a second embodiment.

Referring generally to FIGS. 1 and 2, the mechanical connection element (1) of the invention comprises a body (2) having a cylindrical through-cavity (3). The cavity (3) communicates with the exterior surface (4) of the body (2) by a channel (5) which extends radially from the cavity i.e. from the centre of the cylinder. The sides (7A and 7B) of the channel (5) are spaced apart enough to allow a cross-sectionally rectangular bar (6) to pass into the cavity (3) via the channel (5) when the bar (6) is oriented as shown in FIG. 2. Once entered into the cavity (3), the bar (6) may be changed in orientation by rotation to preclude its removal along the same path.

When the bar is installed in the cavity and because the cavity (3) has a finite depth, even lateral movement (along the long axis of the bar) is highly restricted owing to the friction existing between the bar (6) and the body (2) at the points of contact. These points are the corners of the bar which coincide with the bar's longest perpendicular cross-sectional dimension.

This restriction of lateral movement presents an advantage over the loosely fitting prior art clips discussed above.

The above mentioned friction arises because the diameter of the cylindrical cavity (3) is chosen to be slightly greater but approximately equal to the longest perpendicular cross-sectional dimension of the bar.

The mouth of the channel(5) (where it meets the cavity (3)) may be of varying width. As noted, retention of the bar (6) once inserted into the cavity (3), and following its rotation, is ensured by having a channel mouth narrower than the diameter of the cavity. For instance the channel preferably occupies less than a 90° arc of the cylinder, and more preferably less than a 45° arc.

Rotation of the bar (6) once in the cavity 3), ay be facilitated by flattening the (inner) surface (8) of the cavity (3) either side of the channel (5) as shown in FIG. 2. Indeed it is preferred that the cavity (3) have flat surfaces (8) extending tangentially towards the channel (5) from points (9) about 45° either side of the radius which bisects the channel (5).

Some other preferred embodiments are seen in FIG. 1 such as an overall C-shape for the body (2) and rounded outer contours. Rounded free ends (12) to the C-shaped body (2) are also preferred because they facilitate bar (6) entry into the cavity (3).

The element according to the invention has broad applicability, inter alia because of its modular aspect. Thus, the element may be rigidly securable to a second construction element (e.g. a post) by conventional securing means such as bolts or screws.

Figure 4C:
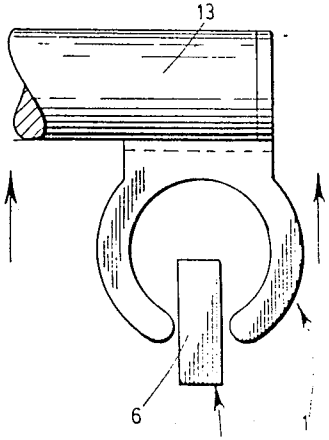
FIGS. 4A to C shows detail of this embodiment.
Figure 4B:
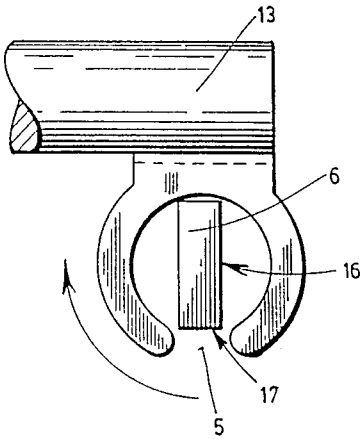
Figure 4A:
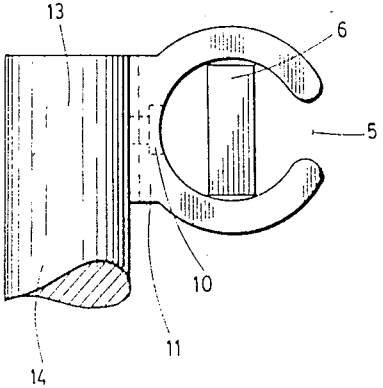

The securing means in this case preferably passes through a specially sunken hole (10) in the back portion (11) of the body (2) (see FIGS. 1 and 4A). This renders the element attachable to a wide variety of other components, so that these other components may enjoy the advantages of the present invention. Chief among these other components are the tips of bunk-bed ladders whose existing clips (e.g. inverted U-shaped) may be modularly replaced by the elements of the present invention.

With this in mind, it is also preferred that the back portion (11) of the body (2) be thickened not only for passage of the securing means but also for formation into a shape suitable for placement next to a secondary construction element.

To avoid the scratching of other components it is preferred to make the connection element from nylon reinforced fibres. Such fibres have the additional advantage of having high mechanical resistance and may therefore carry the securing means discussed above. They also boast the necessary ridigity but exhibit some flexibility to make bar insertion easier.

As mentioned above, one of the chief uses for the present invention is as clips on the tips of ladder side rails to allow the ladder to be removeably affixed to a horizontal bar of the bed.

The use of two of the elements according to the invention, one on each side rail, further augments the friction between the elements (1) and the bar (6) which means that lateral movement (of the ladder along the bar) is scarcely possible.

Hereinbefore, expressions such as "rotation of the bar in the cavity" should be deemed relative inasmuch as "rotation of the cavity around the bar" is an equivalent motion. Thus in the embodiment of the ladder it is simpler to consider the bar as fixed and the connection elements on the ladder side rails as rotating about the bar.

In this embodiment the ladder, when horizontal is affixable to a horizontal bar of an upper bunk bed and yet is securely retained when the ladder is reorientated for use after affixment.

In this embodiment, the two channels (5) of the connection elements (1) on respective side rails face perpendicularly away from the ladder (14) (see FIG. 4A) because the shortest side of the cross-sectionally rectangular bar is horizontal (as is usual) so that the ladder (14) may then be affixed when it too is approximately horizontal. The exact pitch of the ladder (4) needed for affixment depends on the breadth of the channel (5) and on the width of the bar (6). However, generally a channel occupying less than a 45° arc of the cylindrical cavity (3) is preferred and is suitable for the bars normally used in bunk beds.

In the above situation, the connection elements (1) on the ladder side rails (13), in their operational orientation preferably allow the ladder side rails to be at least 45° to the vertical before ladder detachment is possible. This ensures a wide safety margin.

Figure 3C:
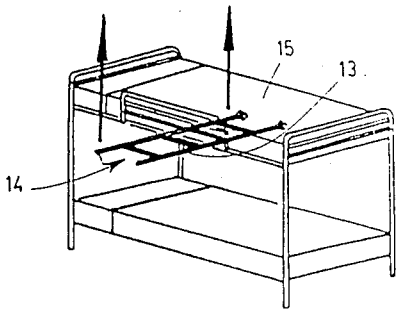
FIGS. 3A to C shows the manner of operation of a third embodiment.
Figure 3B:
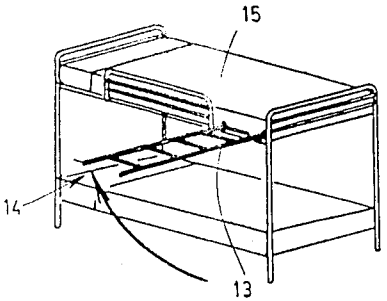

Looking now more particularly at FIGS. 3 and 4, each subfigure (e.g. 4B) of FIG. 4 shows detail of the wider situation in each subfigure (e.g. 3B) of FIG. 3.

Thus the connection elements (1)—FIG. 4—are C-shaped. The bar (6) forming the horizontal component of the bunk has a rectangular cross-section of two approximately vertical, long sides (16) and two, approximately horizontal, short sides (17). The channels (5) of the elements (1) are slightly wider than the short sides.

Figure 3A:
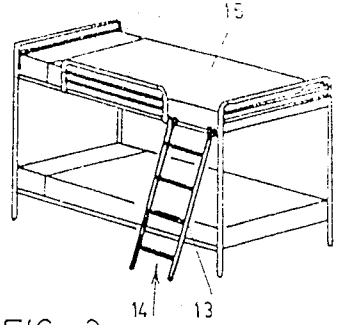

In FIGS. 3A and 4A the ladder is firmly secured either in a vertical position (FIG. 4A) or at about 45° to the vertical (FIG. 3A). In order to remove the ladder (14), it is rotated to an approximately horizontal position (FIGS. 3B and 4B) at which point the short side (17) of the bar (6) is opposite to the channel (5). Now the ladder (14) may be integrally lifted (arrows in FIGS. 3C and 4C) for removal from the bunk (15).

Reversing this process allows affixment of the ladder.

Thus the connection elements according to the present invention provide inter alia ladder brackets which prevent inadvertant disengagement or repositioning or tilting (either lateral or backward) of the ladder while in use.

Although the present invention has been described in relation to preferred embodiments thereof, this is not to be interpreted as a restriction of the scope of this invention which is only limited by the definitions in the appended claims.

What is claimed is:

1. A mechanical connection element for removable and essentially perpendicular connection to a generally cross-sectionally rectangular bar having two long sides and two short sides, said element comprising a substantially rigid body having a cylindrical through cavity able to accommodate said bar by frictional contact thereof with an interior surface of said cavity, said cavity communicating with an exterior surface of said body by a radial, laterally open channel having sides spaced at least slightly more than said short side but less than said long side to allow entrance of said bar into said cavity such that after said entrance, said bar is rotatable to an orientation from which perpendicular exit of said bar from said cavity is prevented;

wherein said channel occupies less than a 45° arc of said cavity; and wherein said cavity has flat surfaces extending tangentially towards said channel from points about 45° either side of a radius bisecting said channel.

2. An element according to claim 1, wherein said body is C-shaped.

3. An element according to claim 2, wherein said body has rounded outer contours.

4. An element according to claim 2, wherein said body is rigidly securable to a second construction element by securing means.

5. An element according to claim 2, wherein said body is integral with a second construction element.

6. An element according to claim 4, wherein said body has a thickened back portion opposite said channel, said portion being adapted to abut said second construction element.

7. An element according to claim 6, wherein said securing means operates through a sunken hole in said back portion.

8. An element according to claim 7, wherein the body is made of nylon reinforced fibres.

9. An assembly wherein said bar defined in claim 6 is a horizontal component of a raised bunk bed and wherein two of said connection elements respectively surmount two side rails on a ladder.

10. A ladder comprising rungs and two side rails for a raised bunk bed having at least one horizontal component wherein each of said side rails is surmounted by one of said connection elements according to claim 6, and wherein said bar is said horizontal component and each of said side rails is a said second construction element of claim 9.

11. A ladder for a raised bunk bed, the ladder comprising rungs and two side rails, each surmounted by a mechanical connection element for removeable and essentially perpendicular connection to a horizontal, generally cross-sectionally rectangular bar having two long sides and two short sides, said bar forming a part of said bed, each of said elements comprising a substantially rigid body having a cylindrical through cavity able to accommodate said bar by frictional contact thereof with an inner surface of said cavity, said cavity communicating with an exterior surface of said body by a radial, laterally open channel occupying less than a 45° arc of said cavity and being approximately perpendicular to said side rails and having sides spaced at least slightly more than said short side but less than said long side to allow entrance of said bar into said cavity, when said ladder is approximately horizontal, said ladder being downwardly rotatable about said bar until the side rails of said ladder ar at least 45° to the horizontal, to prevent exit of said bar from said cavity.

12. A ladder according to claim 11, wherein said bodies are C-shaped.

13. A ladder according to claims 12, wherein each of said cavities has a flat inner surface extending tangentially towards said channel from points about 45° either side of a radius bisecting said channel.

14. A ladder according to claim 13, wherein the ladder is rotatable until at least 50° to the horizontal to prevent said exit thereof.

15. A ladder according to claim 14, wherein the bodies are made of nylon reinforced fibres.

* * * * *